US005990604A

United States Patent [19]

Geis et al.

[11] Patent Number: 5,990,604

[45] Date of Patent: Nov. 23, 1999

[54] FIELD EMMITTERS OF WIDE-BANDGAP MATERIALS

[75] Inventors: Michael W. Geis; Jonathan C. Twichell, both of Acton; Theodore M. Lyszczarz, Concord; Nickolay N. Efremow, Melrose, all of Mass.

[73] Assignee: Massacusetts Institute of Technology, Cambridge, Mass.

[21] Appl. No.: 09/017,361

[22] Filed: Feb. 2, 1998

Related U.S. Application Data

[62] Division of application No. 08/432,848, May 2, 1995, Pat. No. 5,713,775.

[51] Int. Cl.[6] ..... H01J 1/30; H01J 19/24

[52] U.S. Cl. ..... 313/309; 313/336; 313/351; 313/310; 257/10

[58] Field of Search ..... 445/35, 50, 51; 313/309, 336, 351, 495, 310; 439/950, 290, 291; 257/10 Y, 11

[56] References Cited

U.S. PATENT DOCUMENTS

| | | | |
|---|---|---|---|
| 3,678,325 | 7/1972 | Nishida et al. | 313/309 |
| 5,245,248 | 9/1993 | Chan et al. | 313/309 |

OTHER PUBLICATIONS

Bernhole, J. et al., "Theory of native defects, doping and diffusion in diamond and silicon carbide," Materials Science and Engineering, 1992 (no month) pp. 265–272.

Koba, R. "Electronical Photonic Applications of Diamond," Plasma and Laser Processing of Materials, The Minerals, Metals & Materials Society pp. 81–90, 1991 (no month).

Greis M.W. et al., "Capacitance–Voltage Measurements on Metal –S1 $O_2$–Diamond Structures Fabricated with (100)—and (111)—Oriented Substrates," IEEE Transactions on Eletronic Devices, vol. 38, No. 3, pp. 619–626, Mar. 1991.

*Primary Examiner*—Michael Day
*Attorney, Agent, or Firm*—Cesari and McKenna, LLP

[57] ABSTRACT

Improved field-emission devices are based on composing the back contact to the emitter material such that electron-injection efficiency into the emitter material is enhanced. Alteration of the emitter material structure near the contact or geometric field enhancement due to contact morphology gives rise to the improved injection efficiency. The devices are able to emit electrons at high current density and lower applied potential differences and temperatures than previously achieved. Wide-bandgap emitter materials without shallow donors benefit from this approach. The emission characteristics of diamond substitutionally doped with nitrogen, having a favorable emitter/vacuum band structure but being limited by the efficiency of electron injection into it, show especial improvement in the context of the invention. The injection-enhancing contacts can be created by combining the emitter material with an appropriate metal compound and annealing or by conventional dry anisotropic etching or ion bombardment techniques.

84 Claims, 10 Drawing Sheets

FIELD EMMITTERS OF WIDE-BANDGAP MATERIALS

This is a divisional of application Ser. No. 08/432,848 filed May 2, 1995, now U.S. Pat. No. 5,713,775.

This invention was made with government support under ARPA contract no. F1962890C0002 awarded by the Department of Defense. The government has certain rights in this invention.

FIELD OF THE INVENTION

This invention relates to electron-emitting devices. More particularly, this invention relates to structures, compositions, fabrication techniques and methods for increasing the electron emissivity of cathodes suitable for products such as flat-panel video displays.

BACKGROUND OF THE INVENTION

Field emission is a quantum-mechanical phenomenon whereby electrons in a solid tunnel through the energy barrier at the emitter/vacuum interface and are emitted into vacuum under the influence of an electric field. The energy barrier sharpens and the probability of emission increases as the applied voltage between the cathode and an anode or gate electrode increases. For traditional field emitter materials such as silicon, the electron affinity $\chi$ (i.e., the difference between the minimum energy of an electron in vacuum and the conduction band edge), is positive. Electrons in such positive electron affinity materials can tunnel through the barrier at the emitter/vacuum junction with practicable probability only at high electric fields ($\sim 3\times10^9$ V/m). Operation of field emitters, also called cold cathodes, made of these materials requires high applied voltages and local enhancement of the field, such as by an emission tip having small radius of curvature. Furthermore, these field-enhancing geometries render the emitter vulnerable to damage by ion bombardment.

Diamond has been recognized as the most propitious candidate for solid-state field emitters owing to its negative electron affinity ("NEA") under certain conditions (see, e.g., Geis et al., *IEEE Electron Device Letters,* EDL-12, 456–9 [1991]). The NEA exhibited by diamond should be useful for the fabrication of robust field-emission cathodes that operate at low applied fields and without requiring small-radius-of-curvature structures. Although diamond is not the only known NEA material, it is unique in its possession of other attributes desirable for cold cathodes: low chemical reactivity, low chemical sensitivity, high melting temperature, high thermal conductivity, and robust NEA.

Several field-emission devices using diamond cathodes have been described in the literature. These often rely on so-called Spindt geometry to achieve significant emission. Typically the emitter material is part of a film fabricated using chemical vapor deposition ("CVD") methods. Other methods of incorporating diamond which avoid the high cost and slow growth rate of the CVD diamond synthesis process have also been investigated. U.S. Pat. No. 5,608,283 describes the use of carbon-containing particles, including diamond grit, in the formation of emitter structures. U.S. Pat. Nos. 5,252,833 and 5,278,475 describe cold emitters which include a plurality of diamond crystallites that form a layer of polycrystalline diamond. The origin of the diamond material is not addressed by these two disclosures.

Notwithstanding the great appeal of diamond materials for these applications, the achievement of low-voltage, high-current-density cold diamond cathodes has proven to be elusive. The reason for this failure can be better understood with resort to the energy levels in the diamond bandgap.

FIG. 1 is an energy level diagram for an interface between (111)-oriented diamond and vacuum. The bottom of the diamond conduction band $E_C$ is about 0.7 eV above the vacuum electron energy level $E_{VAC}$ (see, e.g., Geis et al., *IEEE Transactions on Electron Devices,* 38(3), 619–626 [1991]). With minimal applied field, electrons in the conduction band could be emitted to vacuum. In undoped diamond, conduction-band electrons are created by thermal activation of an electron from the valence band across the 5.5-eV bandgap. A shallow donor dopant could also be ionized to populate the conduction band and provide a source of electrons for emission. Unfortunately, in current practice no such donors are known, although several elements have been explored as dopants in CVD diamond. Substitutional phosphorous and interstitial sodium occupy shallow donor levels but are not significantly soluble in those positions. Ion-implanted interstitial lithium can act as a shallow donor, but the configuration is not robust to annealing; indeed, lithium-doped diamonds are usually p-type (see, e.g., Geis et al., *IEEE Transactions on Electron Devices,* 38(3), 619–626 [1991]; Bernholc et al., *SiC, Natural and Synthetic Diamond and Related Materials*, Proceedings of Symposium C of the 1990 E-MRS Fall Conference, 265–272 [1990]). Nitrogen has proven difficult to incorporate into CVD diamond; the introduction of nitrogen into the process results in a degradation of the diamond crystal structure. In type Ia natural diamond, nitrogen exists in aggregates that form deep donor levels far below the vacuum energy level. In type Ib, high-pressure synthetic diamond, donor nitrogen occupies substitutional positions about 1.7 eV below the conduction band; this position represents the highest stable dopant energy level known in diamond.

However, since the highest donor energy level in diamond is 1 eV below the vacuum level, significant applied fields are still required to allow field emission, notwithstanding the favorable position of the conduction band edge. The lack of practical shallow n-type dopants has been an obstacle to taking advantage of the NEA properties of diamond (see, e.g., Koba, *Plasma Laser Process. Mater.* [pap. conf.], Upadhya et al., eds., Miner. Met. Mater. Soc., [1991]).

U.S. Pat. No. 5,463,271 discloses a surface treatment for diamond that further lowers the vacuum energy level with respect to the electron energy level at the diamond surface. As is evident from FIG. 1, even a 1-electron-volt decrease in the work function of the emitter surface does not enable electrons at the deeper donor levels to be efficiently emitted at low applied voltages. Such a decrease would, however, permit emission of electrons from diamond with substitutional nitrogen donors into vacuum without barrier.

The historical development of field-emitter technology has nonetheless effected an implicit bias against this type of material on the basis of its high electrical resistivity—for example, type Ib diamond containing substitutional nitrogen donors to a concentration of about $10^{19}$ atoms $cm^{-3}$ exhibits electrical resistivity levels greater than $10^{16}$ ohm-cm at low field strength. Previous cold cathode technologies have used materials such as metals or doped silicon as the emitter material. For such electrically conductive materials, the value of the electrical resistivity is an important figure of merit in the design of cold cathodes. However, for a wide-bandgap emitter material without shallow donors, such as diamond, the properties at the back contact transcend the bulk resistivity, especially at low field strengths; in other words, electron injection into the emitter material is the rate-limiting process. Yet despite the mediocre emission characteristics of higher-electrical-conductivity diamond compositions in cold-cathode applications, practitioners have continued to emphasize their use.

Improvements in the emission characteristics of diamond cold cathodes have been achieved through innovation in the geometry and chemistry of the diamond/vacuum interface. Unfortunately, scant research attention has been devoted to optimizing the features of the back contact with the diamond which are necessary for efficient electron injection, which would expand the range of materials—including those with highly favorable NEA properties—useful in the production of efficacious cold cathodes.

DESCRIPTION OF THE INVENTION

Objects of the Invention

An object of the present invention is, accordingly, the fabrication of high-efficiency cold cathodes of wide-bandgap materials, such as diamond, silicon carbide, boron nitride, gallium nitride, and aluminum nitride.

Another object of the invention is to provide a set of processes for forming a back contact to an emitter that not only provides electrical communication with the remainder of the device circuit but also promotes electron injection into the emitter material.

Another object of the invention is to incorporate diamond material with substitutional nitrogen donors at energy levels near the conduction band edge into field-emitter devices in a manner that would overcome the geometric and processing constraints and high operating voltages of existing technologies.

Another object of the invention is to provide a set of low-temperature processes for fabricating cold emitters.

Still another object of the invention is to achieve a set of processes for fabricating cold emitters from diamond in the form of grit substitutionally doped with nitrogen.

BRIEF SUMMARY OF THE INVENTION

The present invention improves the emission characteristics of cold cathodes with respect to those of the prior art by overcoming the obstacle to injection of electrons into wide-bandgap emitter materials. The processes of the invention provide a back contact to the emitter material that enhances electron injection at lower applied potential differences. The space charge created by the ionization of donors in the vicinity of the contact, in conjunction with the alteration of the emitter material structure near the contact or with local field enhancement due to contact morphology, promotes electron injection.

In one aspect, the invention concerns fabrication of emitters by application of a treatment substance containing one or more metallic elements to the emitter material and annealing in a reducing environment. This process results in a roughened back contact between the emitter material and a conductive material. The process may additionally couple the emitter material to a device substrate which provides mechanical support and communicates electrically with the power supply. Materials containing a metal of the iron triad or lanthanide series or titanium are especially effective treatment substances for diamond emitter materials; a gaseous atmosphere containing hydrogen gas—especially one additionally containing water vapor or mist—provides an effective annealing environment.

In a second aspect, the invention concerns fabrication of emitters using conventional dry etching techniques. A masking material that is etched more slowly by the etching method than is the emitter material is deposited onto the surface of the emitting semiconductor to mask at least part of the exposed surface of the emitter material. The semiconductor is etched using a conventional dry anisotropic etching procedure, wherein the emitter material is etched more rapidly normal to than parallel to its surface. When the mask material has been removed completely, the resulting surface of the emitter material is irregular. Physical deposition techniques such as sputtering or evaporation are then used to fill the cavities with metal to form the back contact. For diamond emitter material, aluminum is one suitable mask material; gaseous nitrogen dioxide with a xenon-ion beam provides an effective anisotropic etchant; aluminum, nickel, titanium, gold and tungsten are appropriate metals for deposition onto the etched surface. For wide-bandgap nitrides, such as those of boron, aluminum, gallium or indium, chlorine gas instead of the nitrogen dioxide is efficacious. Silicon carbide can be etched in a plasma of species containing fluorine.

In a third aspect, the invention concerns fabrication of emitters after modification of the surface of the emitter material by ion bombardment. After the surface region of the emitter material has been sufficiently altered by ion collisions, the back contact is formed by deposition of a metal layer, as described above. Conventional ion implantation, which uses ions having mean energy in excess of 20 keV and as high as 1000 keV, of carbon ions into diamond produces a rough surface at which the back contact is then completed. Bombardment by ions of much lower energy than is used for ion implantation also modifies the emitter surface favorably for formation of a back contact with efficient electron injection. Bombardment of diamond by xenon ions, for example, at energies as low as 1 keV results in back contacts having the desired emission characteristics.

These types of treatment form back contacts allowing efficient electron injection into the emitter material. The details of the treatment depend on the composition and form of the emitter material being used and the specific geometry of the device.

In one approach, the present invention exploits the auspicious position of the energy level of substitutional nitrogen in the diamond bandgap for efficient field emission. It is a feature of the invention that it does not circumscribe the morphology or the method of fabrication of diamond used for emitters in these embodiments. Virtually any diamond material substitutionally doped with nitrogen—whether it be grit, a large single crystal, or a film and whether it be manufactured by an equilibrium, high-pressure technique or by CVD, or found in nature—can realize the benefits of the present invention. Hence the present invention affords flexibility to use the fabrication method best suited to the desired application without sacrifice of the property of interest, i.e., enhanced electron emissivity.

BRIEF DESCRIPTION OF THE DRAWINGS

The foregoing discussion will be understood more readily from the following detailed description of the invention, when taken in conjunction with the accompanying drawings, in which.

It will appreciated that, for purposes of illustration, these figures are not necessarily drawn to scale.

DETAILED DESCRIPTION OF THE INVENTION

Figure 2A:
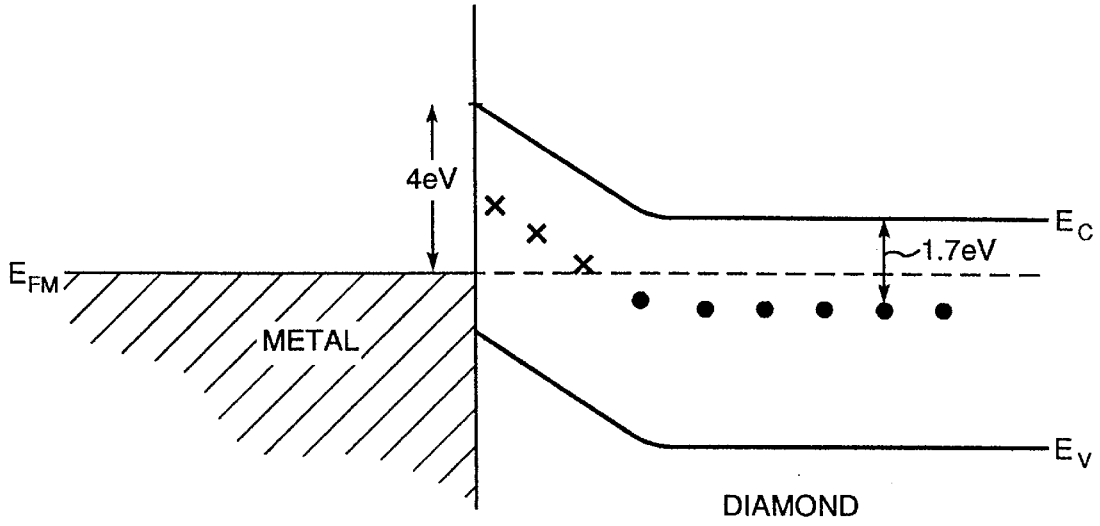
FIGS. 2A and 2B illustrate the band structure at an interface between a metal substrate and a diamond cathode containing substitutional nitrogen at 1.7 eV below the conduction band edge, FIG. 2A depicting the band structure in the absence of an applied voltage and FIG. 2B depicting the band structure under imposition of sufficient reverse bias to allow tunneling of electrons from the metal into the diamond.

The difficulty of injecting electrons from an electrical conductor into a diamond cathode and the success of the present invention in circumventing that difficulty can be explained using band theory. Consider, with reference to FIGS. 2A–2B, a junction between a metal substrate and a diamond cathode containing substitutional nitrogen at 1.7 eV below the conduction band edge $E_C$. Such a junction between metal and semiconductor is known as a Schottky diode. Equilibrium is established at the junction by flow of electrons until the Fermi level is uniform across the diode. If the work function of the metal is greater than that of the semiconductor, when the junction is formed electrons leave donors in the vicinity of the junction and flow from the semiconductor into the metal to equalize Fermi levels in the two materials. The ionized donors form a positively charged depletion layer in the semiconductor which induces a negative surface charge in the metal at the interface. FIG. 2A shows the resulting band structure at the metal/diamond junction in the absence of an applied voltage. For n-type diamond the conduction band edge at the junction lies about 4 eV above the metal Fermi level $E_{FM}$. In order for an electron to traverse the junction from metal to diamond, it must either overcome the Schottky barrier represented by band bending at the junction or tunnel through the barrier into the diamond conduction band. As the figure shows, a transfer from the metal Fermi level to the diamond conduction band edge is not energetically favored at equilibrium.

Figure 3A:
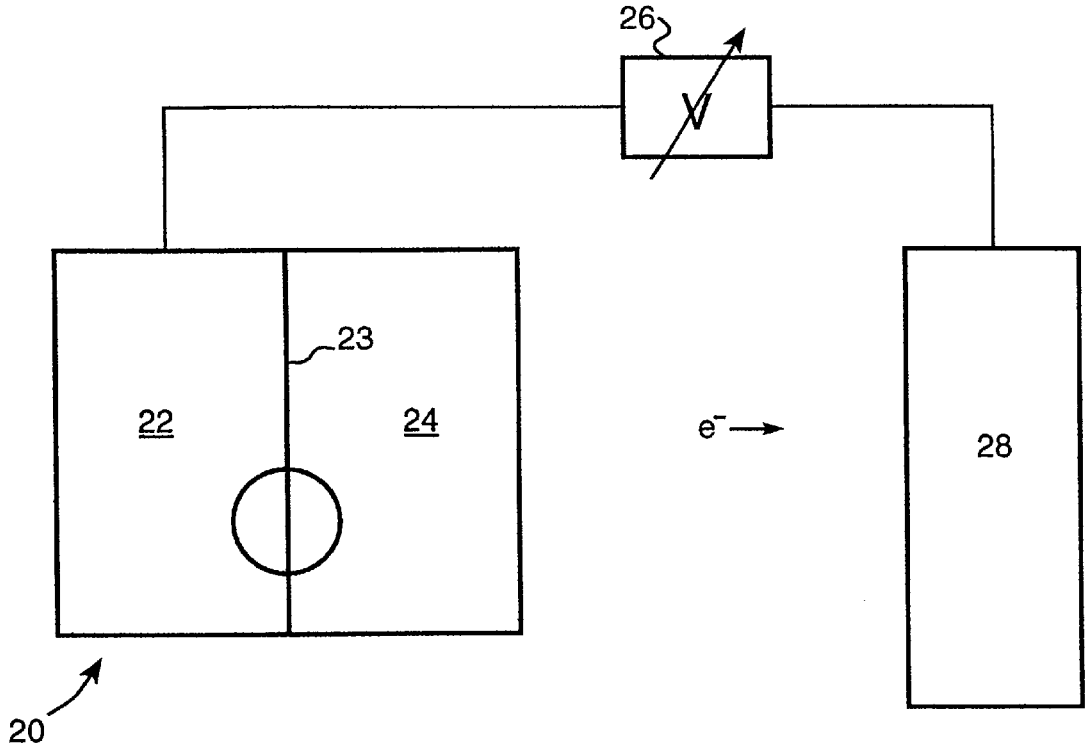
FIG. 3A schematically illustrates a representative emitter circuit containing a Schottky diode.
Figure 3B:
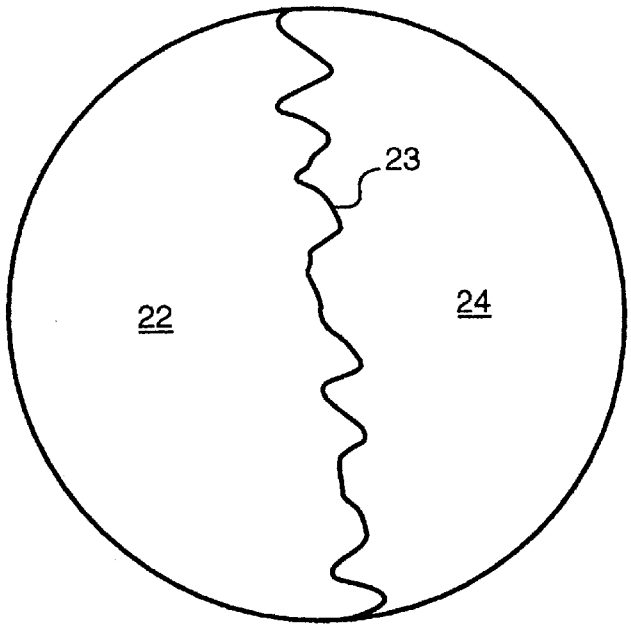
FIG. 3B is an enlargement of a portion of a possible morphology of the metal-diamond interface depicted in FIG. 3A.

The dynamic equilibrium can be disturbed by the imposition of a bias voltage on the Schottky diode. Refer now to FIGS. 3A and 3B, which illustrate the manner in which the relative positions of the energy levels shown in FIG. 2A can be changed by the imposition of a bias voltage using an external power supply as part of a simple emitter circuit. As shown in the figures, the Schottky diode, denoted representatively by reference numeral 20, includes a metal layer 22 in contact with a diamond layer 24; the two layers meet at an interface 23. A variable-voltage power supply 26 imposes a potential difference between the diode 20 and an anode 28. Diamond layer 24 and anode 28 oppose one another across a vacuum.

Figure 2B:
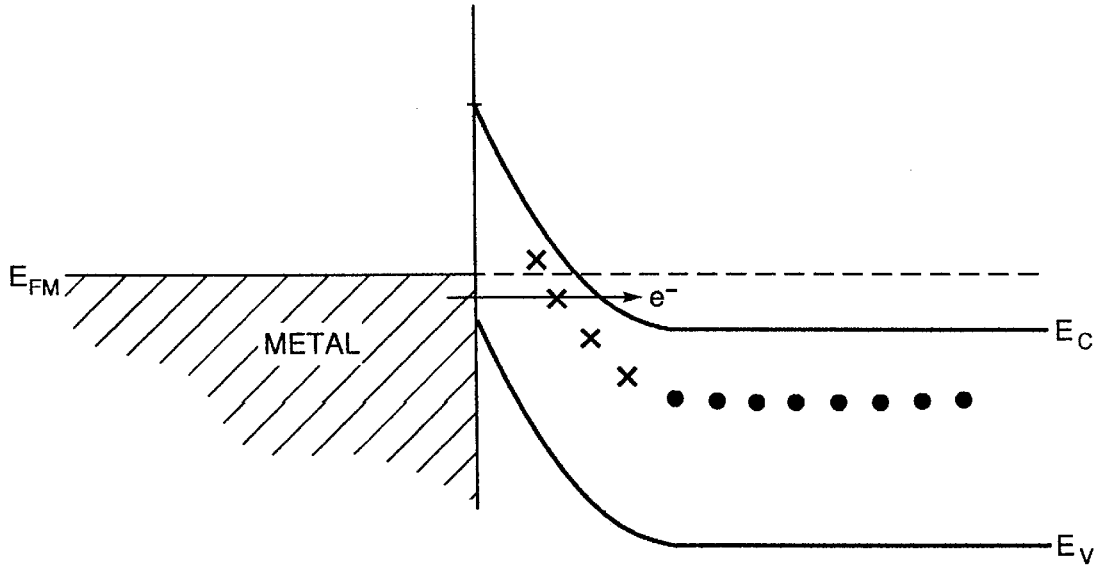

During operation the power supply 26 imposes a reverse bias on the Schottky diode 20. The reverse bias increases the energy difference between band edges of the diamond at and away from the junction with respect to the case illustrated by FIG. 2A. Since the band edges remain fixed at the junction, the result is a decrease in the difference between the conduction band edge far from the junction and the metal Fermi energy $E_{FM}$. Refer now to FIG. 2B, which depicts the alteration of the band structure by a reverse bias voltage sufficient to bring the diamond conduction band edge $E_C$ to a lower value than the metal Fermi level $E_{FM}$. Under these conditions it is possible for electrons to quantum mechanically tunnel across interface 23 into the diamond conduction band.

Figure 1:
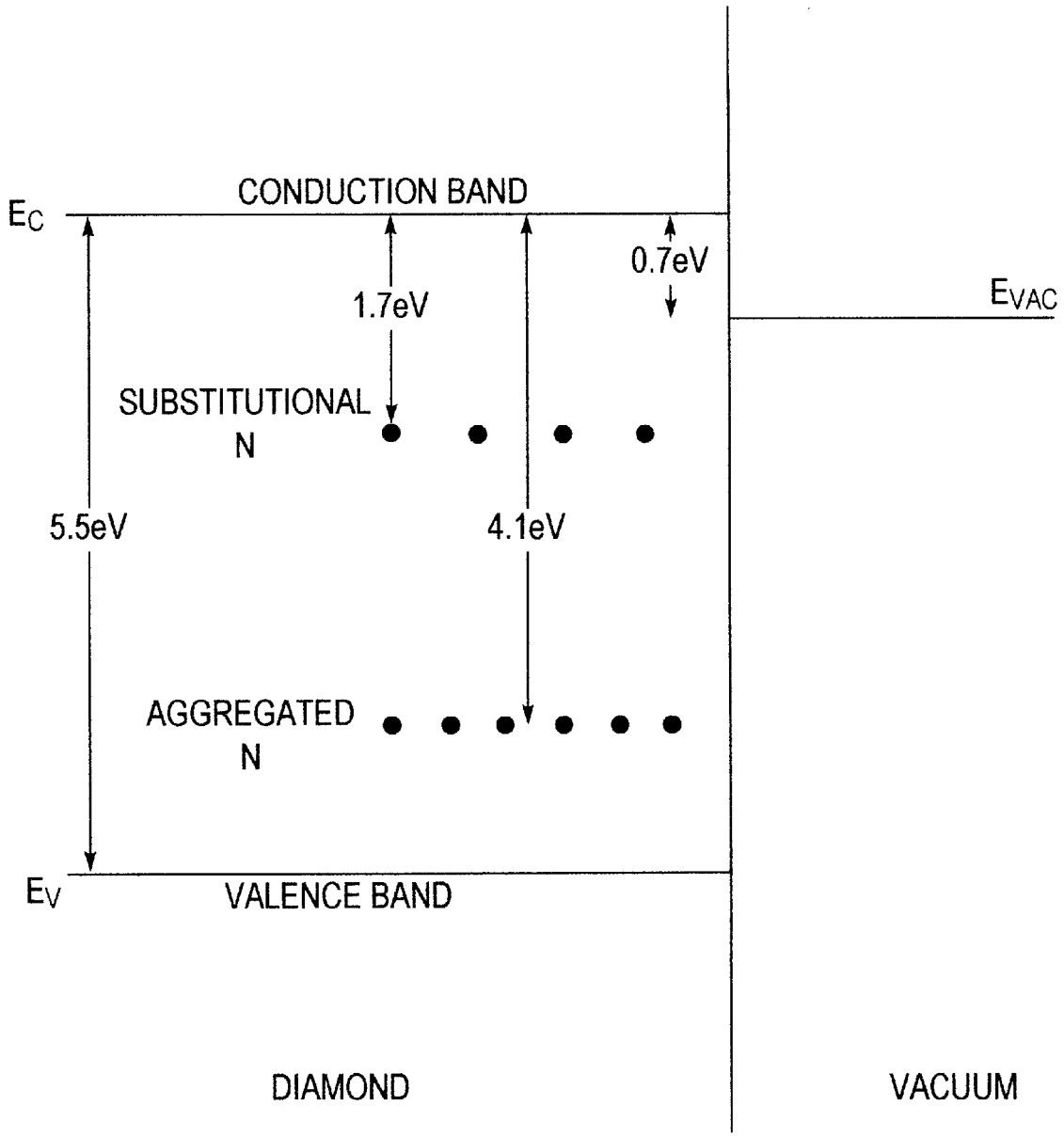
FIG. 1 (PRIOR ART)
FIG. 1 depicts energy levels at an interface between 111-diamond and vacuum.
Figure 4:
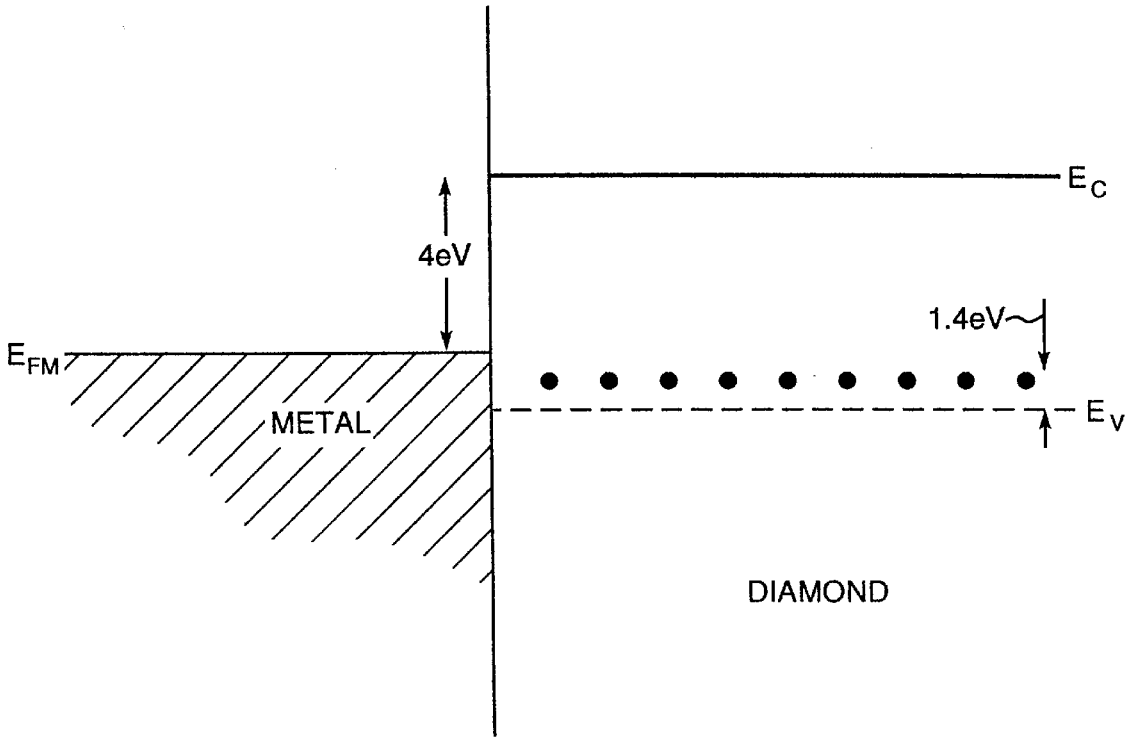
FIG. 4 illustrates the band structure at an interface between a metal substrate and a diamond cathode containing a deep donor more than 4.0 eV below the conduction band edge.

Proper operation of the cold cathode will only ensue under voltage sufficient to enable two processes: the injection of electrons across interface 23 from metal layer 22 into diamond layer 24 and the emission of electrons from diamond layer 24 into the vacuum to anode 28. FIG. 1 indicates that diamond doped with substitutional nitrogen has an advantageous energy structure compared to other diamond compositions for efficient emission at low applied potential differences. However, the overlooked advantage of substitutionally nitrogen-doped diamond over other diamond compositions with regard to injection is also of great significance. FIG. 4 shows the band structure of a junction between metal and diamond doped with a deep donor. For diamond material undoped or containing donors at levels more than 4 eV below the conduction band edge, dopant ionization is not required for equalization of the diamond and metal Fermi levels. Consequently, no space charge layer or downward band bending is induced in such material on formation of a Schottky diode as described above; the probability of tunneling into the diamond is substantially reduced. The application of a reverse bias to the diode cannot induce space-charge formation and electron injection into the diamond as it does for the substitutional-nitrogen-doped material.

Figure 5:
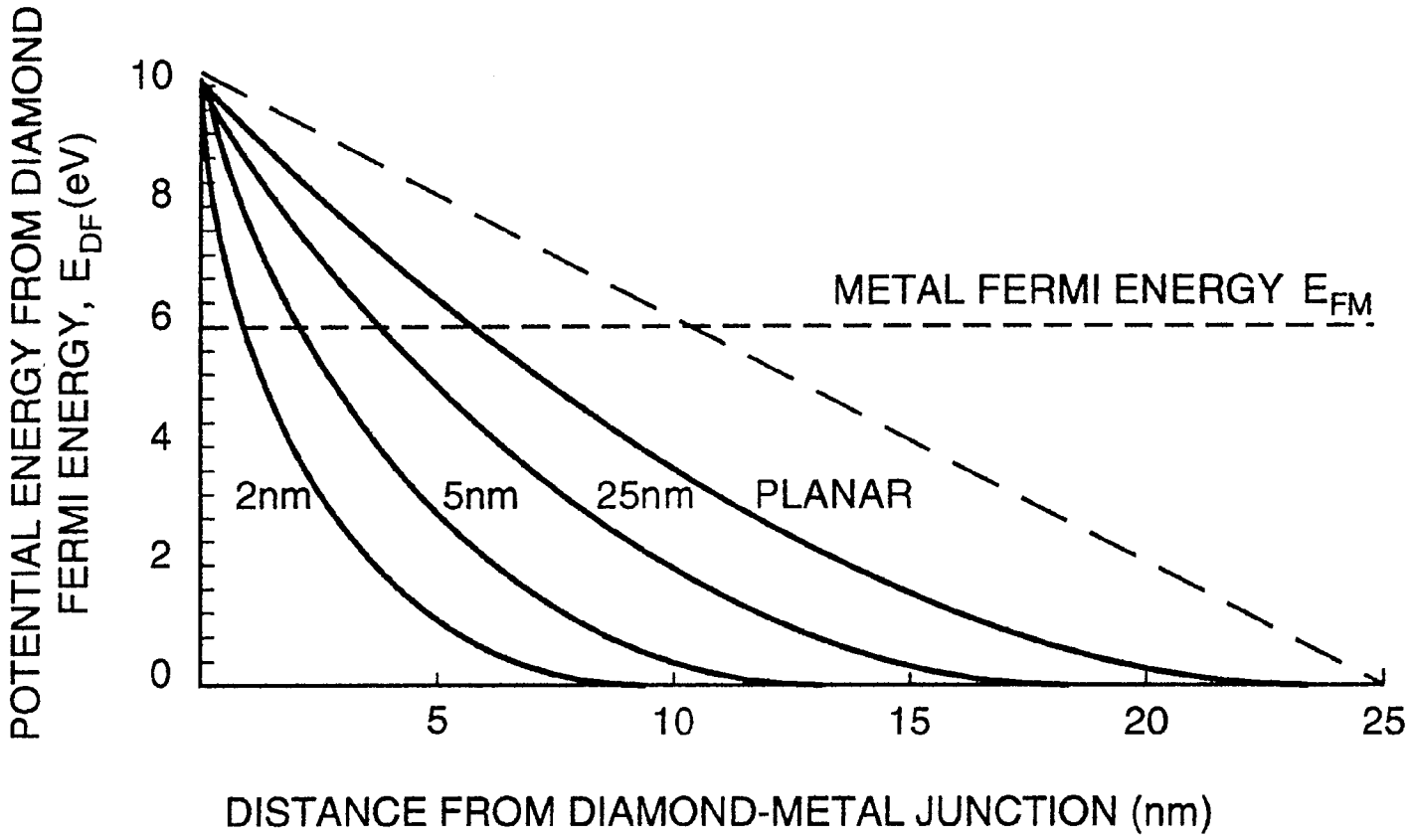
FIG. 5 graphically depicts the effect of metal/diamond contact geometry on the electron injection barrier width and the field enhancement due to substitutionally placed nitrogen dopant compared to undoped material.

The profile of the energy barrier at the junction can be further sharpened if the interface assumes a morphology with a small effective radius of curvature. This principle is illustrated in FIG. 5, which shows the decrease in barrier width due to field amplification by interface geometry for diamond doped to $10^{-19}$ $cm^{-3}$ with substitutional nitrogen. Each curve, labeled with the radius of a metal sphere, indicates the distance into diamond from a spherical metal-diamond interface at which the metal Fermi energy is higher than the diamond conduction band edge away from the interface. In particular, the barrier width can be reduced to ~2 nm by roughening interface 23 (see FIG. 3B) to a 5 nm radius of curvature. The inclined dashed line in FIG. 5 depicts the potential of a planar interface with undoped diamond material at a local electric field strength of $4\times10^6$ V $cm^{-1}$.

Such a roughened interface 23 can be formed by treatment with a substance containing a metallic element, specifically metals that dissolve diamond or with their compounds. These include the iron triad, the lanthanides, and titanium. One possibility is using a substance containing both nickel and cerium, such as a nickel-cerium alloy. For example, nickel in the solid or liquid phase etches diamond and deposits the equilibrium form of carbon, namely, graphite. If then exposed to hydrogen at high temperature, the deposited graphite is removed by nickel-catalyzed formation of methane. Because the hydrogen-carbon-nickel system exhibits a eutectic, the reaction can occur at temperatures below the melting point of nickel. Similar results can by achieved by use of nickel compounds. For example, examination by scanning electron microscopy shows that diamond-nickel interfaces formed by heating nickel acetylacetonate hydrate to about 1000° C. on diamond in the presence of hydrogen gas have a surface topography characterized by a radius of curvature less than or equal to 10 nm. In the back contact of an emitter, this morphology enhances emission by promoting electron injection from the conductor into nitrogen-doped diamond at low potential difference. The emitter performance is especially good when the heating environment also includes water vapor or mist. Other nickel salts, such as the sulfate and chloride, also give rise to the desired interface geometry with similar treatment. For use with diamond grit, for which the material with which the interface is formed also adheres the emitter material to a substrate, the treatment with organic salts is preferred.

Another technique for forming a rough back contact applies conventional semiconductor dry etching methods. For example, a material that is removed more slowly by the etchant than is diamond, such as aluminum, is deposited on the surface of the diamond to form a mask. For heightened surface relief the masking material can be patterned before etching using, for example, a standard integrated circuit lithography technique such as photoresist with wet chemical etching. The coated diamond is placed in an anisotropic etching system, so that etching occurs faster in the direction normal to exposed surface of the diamond layer than laterally into regions covered by masking material. For diamond, a typical etching system comprises a directed xenon ion beam and a flux of nitrogen dioxide, which reacts with the diamond to form carbon monoxide and carbon dioxide when catalyzed by the energetic ions (see, e.g., Efremow et al., *J. Vac. Sci. Technol. B,* 3(1), 416–8 [1985], herein incorporated by reference). As the mask is eroded, small regions of the diamond are exposed and begin to be etched. When the mask has been removed, an irregular diamond surface remains. Formation of the back contact can be completed by, for example, sputtering or evaporative application of a thin coating of a metal showing good adhesion to diamond, like aluminum, nickel, titanium, gold or tungsten, followed by plating of a thicker layer of compatible structural metal. Wide-bandgap nitride materials like boron, aluminum, or gallium nitride could be etched by this technique using chlorine gas instead of the nitrogen dioxide with the formation of nitrogen gas and the volatile trichloride of the group 3a element. Silicon carbide could be etched by a plasma of fluorine-containing species.

An effective back contact can also be constructed by disrupting the emitter surface by ion bombardment and forming the metal contact to the altered emitter surface by sputtering or evaporation as indicated above. Conventional ion bombardment techniques, such as are described for thin films of p-type diamond in published PCT Application No. 9,315,523, herein incorporated by reference, can be used to prepare the emitter surface. At current densities of about $10^{-5}$ A $cm^{-2}$, carbon ion fluences from about $3.0\times10^{16}$ to $4.0\times10^{16}$ with ion energies of about 50 to 170 keV on a heated diamond surface generate a suitable topography for back contact formation.

Bombardment of a diamond surface by ions of much lower energy—less than 20 keV—than is conventionally used for ion implantation also modifies the emitter surface favorably for formation of the back contact with efficient electron injection. Mean ion energies less than 5 eV are preferred for this technique. For example, bombardment of a diamond surface by xenon ions having energies of 1200 eV at 0.1 mA $cm^{-2}$ for ten minutes followed by deposition of metal onto the bombarded surface results in excellent emitter characteristics. This technique has the advantage of requiring no heating of the diamond or a device substrate during processing and thus allows use of a wider range of substrate materials.

If the junction between the emitter material and a material of higher electron affinity, such as the device substrate, is exposed to the evacuated operating environment of the device, the contact potential between the emitter material and the higher-electron-affinity material gives rise to an electric field that inhibits the escape of electrons from the emitter material. However, if the emitter material covers the substrate surface, the electric field will only adversely affect the edges of the diamond coating. The benefits of the invention are best realized when the emitter material forms a continuous coating on any higher-electron-affinity substrate or contact material. Alternatively, the spaces between regions of emitter material can be coated with an insulator, a low-electron-affinity material such as cesium, or an alkali metal salt like cesium chloride or cesium carbonate.

It must be emphasized that, although the present invention enables the construction of efficient cold cathodes from high-pressure synthetic diamond now available, it is not limited to any particular diamond synthesis technique. The advantages of emitters according to the present invention are realized with virtually any form of diamond, substitutionally doped with nitrogen, that has been processed to allow injection of electrons into the diamond at reasonably low applied potential differences. The diamond emitter structure can be fabricated, for example, by CVD or by application of high-pressure diamond in the form of small crystallites or of a larger single crystal.

Figure 6:
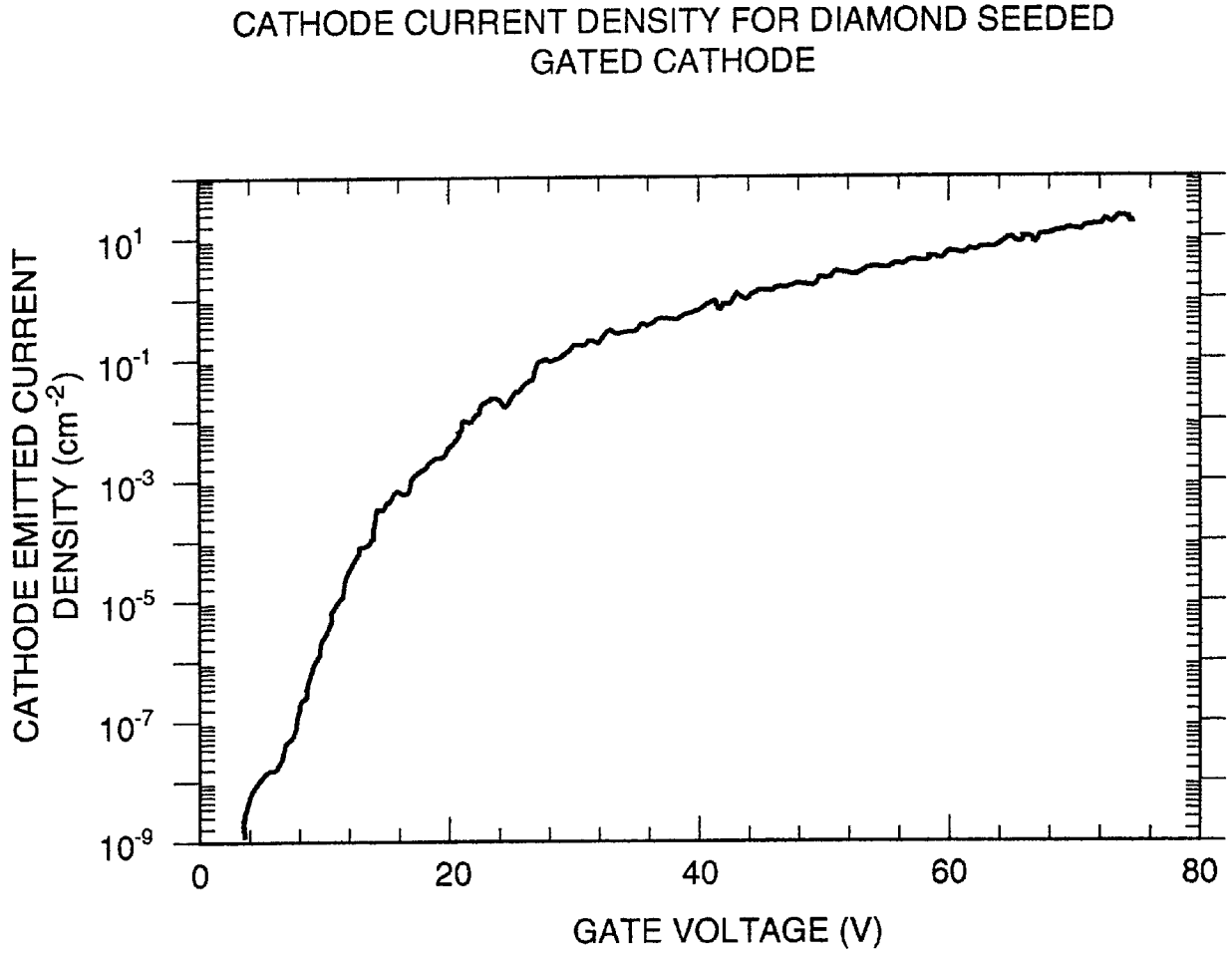
FIG. 6 graphically depicts the performance characteristics of an emitter device of the invention.

The devices of the present invention are able to emit electrons at high current density and lower applied potential differences and temperatures than previously achieved. FIG. 6 depicts the emission current density as a function of gate voltage for a device fabricated according to the processes of this invention. Densities appropriate for displays and instrumentation, in the range from 0.1 to 10 mA/$cm^2$, are obtained with gate voltages of 15 to 20 V. Current densities required by power devices, in the 1 to 20 mA/$cm^2$ range, are obtained with gate voltages of 50 to 100 V. The uniquely low voltages required for emission may make it possible to replace the silicon substrate and oxide dielectric delineated in the following examples with low-cost metallized plastic structures. Useful applications include plastic sheet lighting and plastic displays. The ability to integrate both the cathode and integrated circuits make new vacuum instrumentation possible. Additionally, the ease of fabrication makes possible large area (on the order of a square foot) cathodes that allow for the switching of large currents (on the order of 10,000 A). Such devices would be practical for high-current, high-voltage switching applications in which the space-charge voltage drop of about 60 V would not be excessive.

The electron emissivity of these diamond structures can be further augmented by treating them with electronegative matter and electropositive matter in the manner described in U.S. Pat. No. 5,463,271, herein incorporated by reference. After fabrication of an emitter structure according to the following examples, exposure to an oxygen plasma for a few minutes improves the emitter efficiency. Subsequent addition of cesium either by direct evaporation or by decomposition of cesium azide further increases the efficiency.

The foregoing principles apply equally well to other wide-bandgap emitter materials. The methods of the present invention can be applied to materials such as silicon carbide, boron nitride, gallium nitride, and aluminum nitride to great advantage over the existing technologies. A suitably configured back contact to any emitter material having an appropriate band structure can exhibit efficient injection at low applied potential differences.

The fabrication of field emitters with injection-enhancing back contacts to substitutionally doped nitrogen and other wide-bandgap emitter materials can be achieved according to the processes described in the following examples.

EXAMPLES

Example 1

High-pressure synthetic diamond grit doped with $10^{19}$ atoms $cm^{-3}$ substitutional nitrogen was treated with a $CF_4$—$O_2$ plasma to improve colloid stability. A colloidal suspension of treated grit having dimension 500 to 1000 Å was prepared in acetone in the ratio of 0.1 grams of grit per 100 ml of acetone. The grit was dispersed in the solvent by ultrasonic agitation and then was deposited onto a silicon wafer to form a continuous layer by boiling off the solvent. Nickel acetylacetonate hydrate was added in a second solvent rinse. The structure was heated in an argon atmosphere containing 1 to 2% hydrogen to 950° C. for ~5 seconds.

Example 2

High-pressure synthetic diamond grit having dimension 500 to 1000 Å and doped with $10^{19}$ atoms $cm^{-3}$ substitutional nitrogen was treated with a $CF_4$—$O_2$ plasma to improve colloid stability. Coarse powder of nickel acetylacetonate hydrate was crushed to the same appearance as the grit. The grit and nickel salt powder were mixed together at a ratio of 5 parts diamond to 1 part nickel salt by weight. A colloidal suspension of the mixture was prepared in acetone in the ratio of 0.1 grams of solid per 100 ml of acetone. The mixture was dispersed in the liquid by ultrasonic agitation. The solids were deposited to form a continuous layer on a silicon wafer by boiling off the solvent. The structure was heated to 1100° C. for ~5 seconds in an argon atmosphere containing 1% to 2% hydrogen.

Example 3

Figure 7A:
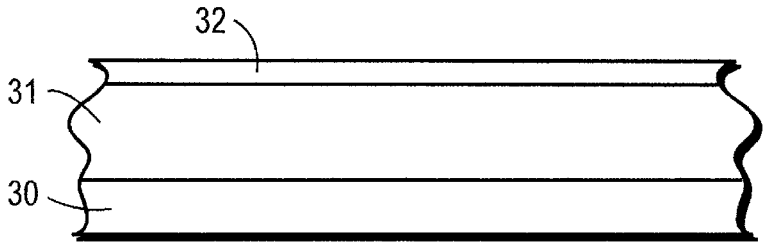
FIGS. 7A–7D are enlarged elevations that illustrate the structure of a gated cathode of the invention, representing steps in part of an inventive process for fabricating the electron-emitting structure of the device.
Figure 7B:
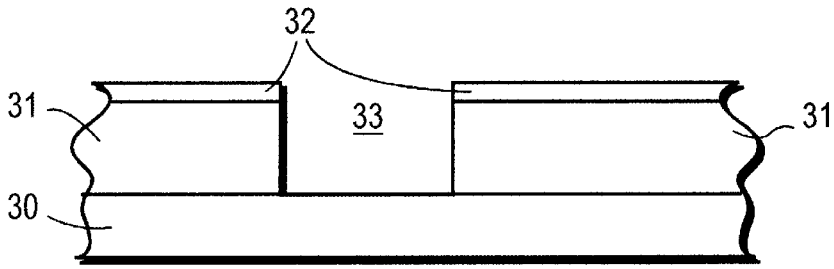
Figure 7C:
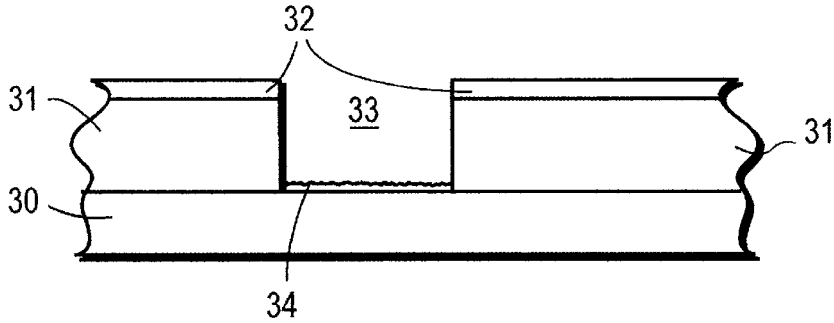
Figure 7D:
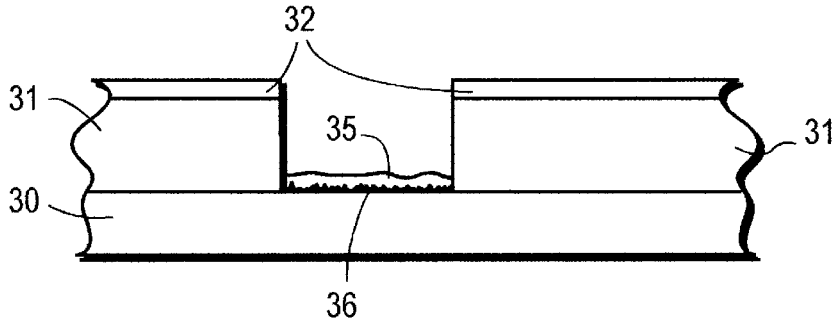

A gated cathode structure was constructed by first fabricating a sandwich structure, such as is shown in FIG. 7A, comprising a conductive silicon substrate 30, a silicon dioxide dielectric spacer 31, and a tungsten film 32. Conventional photolithographic techniques were used to pattern 1-to-5 μm diameter holes through the metal film 32 and the dielectric spacer 31. One such hole 33 is shown in profile in FIG. 7B. A colloidal suspension of diamond grit was prepared as described in Example 1. A continuous layer of the grit was deposited at the bottoms of the holes from colloidal suspension by electrophoresis. In suspension the grit is negatively charged so a positive bias on the cathode substrate deposits the grit preferentially at the bottom of the hole. The thickness of the deposited diamond grit film depended on the applied voltage and was nearly independent of time after the first few minutes of electrophoresis. The resulting configuration, in which the diamond grit 34 covers the conducting substrate at the bottom of the hole, is shown in FIG. 7C. Nickel acetylacetonate hydrate was added in a solvent rinse. The structure was heated in an argon atmosphere containing 1 to 2% hydrogen to 1000° C. for ~5 seconds. The treatment resulted in a layer of grit 35 having a roughened interface with a layer of nickel 36 whereby the grit is also adhered to the silicon substrate 30, as shown in FIG. 7D.

Example 4

Silicon carbide grit having dimension less than 1 μm and doped with nitrogen was treated with a $CF_4$—$O_2$ plasma to improve colloid stability. A colloidal suspension of treated grit was prepared in acetone in the ratio of 0.1 grams of grit per 100 ml of acetone. The grit was dispersed in the solvent by ultrasonic agitation and then was deposited in a continuous layer on a silicon wafer by boiling off the solvent. Nickel acetylacetonate hydrate was added in a second solvent rinse. After addition of the nickel salt, the structure was heated in an argon atmosphere containing 1 to 2% hydrogen to 1000° C. for ~5 seconds.

Example 5

A high-pressure synthetic diamond having dimension about 1.3 mm and doped with $10^{19}$ atoms $cm^{-3}$ substitutional nitrogen was coated with nickel acetylacetonate hydrate powder and placed on a nickel substrate. The structure was heated in an argon atmosphere containing 1 to 2% hydrogen to 900 to 1000° C. for ~5 seconds.

Example 6

Figure 8A:
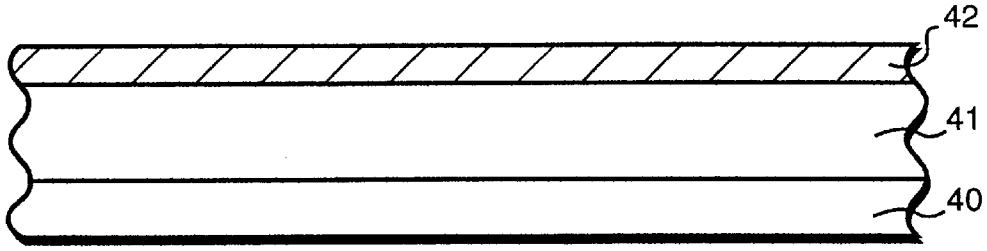
FIGS. 8A–8E are enlarged elevations that illustrate the formation of a metal/diamond back contact using conventional semiconductor etching techniques, representing steps in part of an inventive process for fabricating the electron-emitting structure of the device.
Figure 8B:
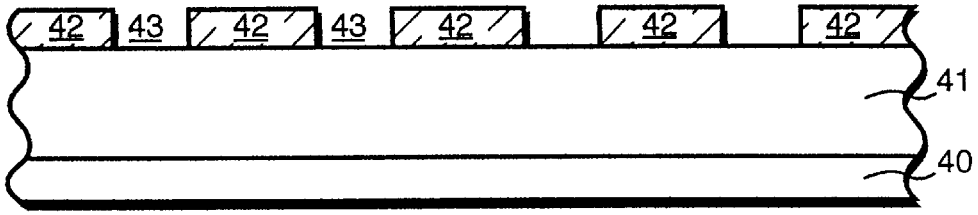
Figure 8C:
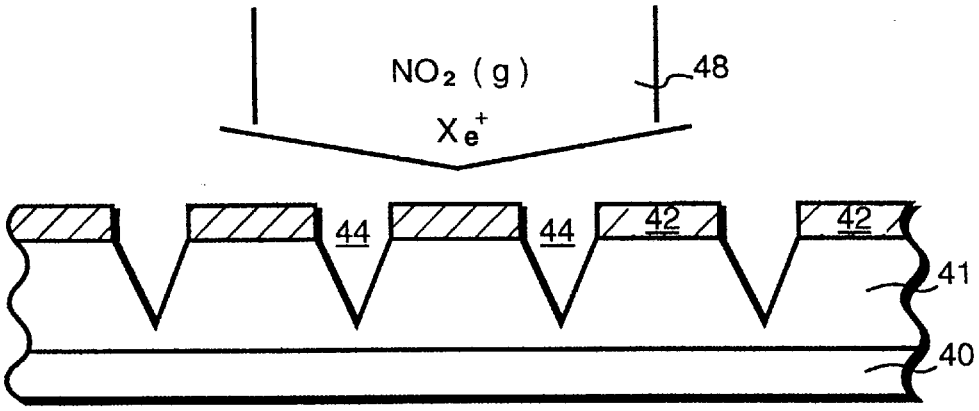
Figure 8D:
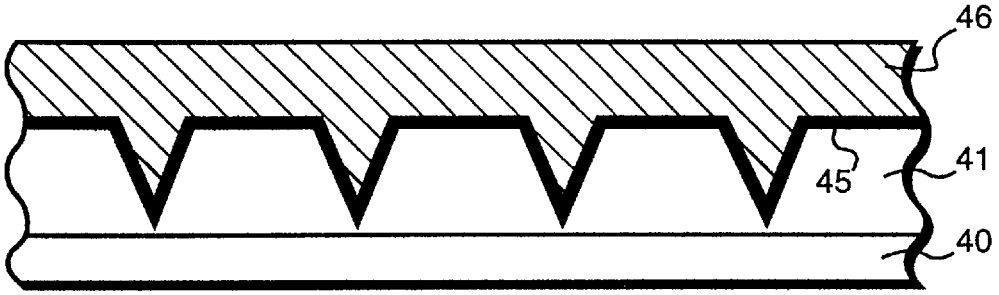
Figure 8E:
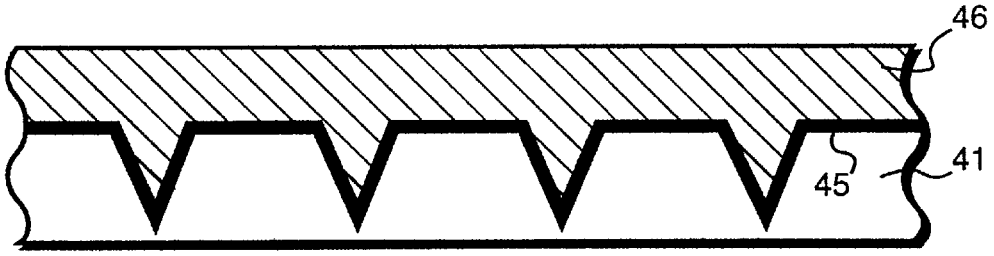

A structure, such as is shown in FIG. 8A, was made of a layer of diamonds 41 having average dimension 20 μm to 1 mm attached using adhesive to a smooth carrier substrate 40 and then coated with 100 nm of electron-beam-evaporated aluminum 42. An array of circular holes 43 having diameter ~5 μm, shown in FIG. 8B, was patterned into the aluminum layer 42 using photoresist and wet chemical etching. FIG. 8C shows a flux 48 comprising a Xe+ ion beam of 1 keV and nitrogen dioxide directed toward the patterned surface. The resultant etching of the exposed diamond 41 continued until the aluminum 42, which was etched at a rate equal to approximately 1% of the diamond etch rate, had been removed completely. The process excavated conical holes 44 ~1 to 10 μm deep. FIG. 8D shows metal layers 45 and 46 applied to the etched diamond surface: a thin coating of nickel 45 covered by additional nickel plated to form a structural layer 46 thicker than 100 μm. The adhesive was dissolved to remove the carrier substrate 40 from the diamond and thereby expose the diamond electron-emitting surface, as shown in FIG. 8E. Electrical contact to the emitter was made at the surface of the metal layer 46.

Example 7

Figure 9A:
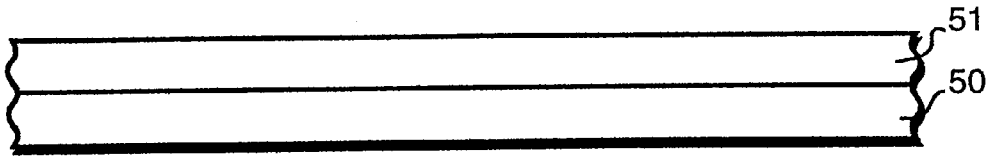
FIGS. 9A–9D are enlarged elevations that illustrate the formation of a metal/diamond back contact using ion implantation, representing steps in part of an inventive process for fabricating the electron-emitting structure of the device.
Figure 9B:
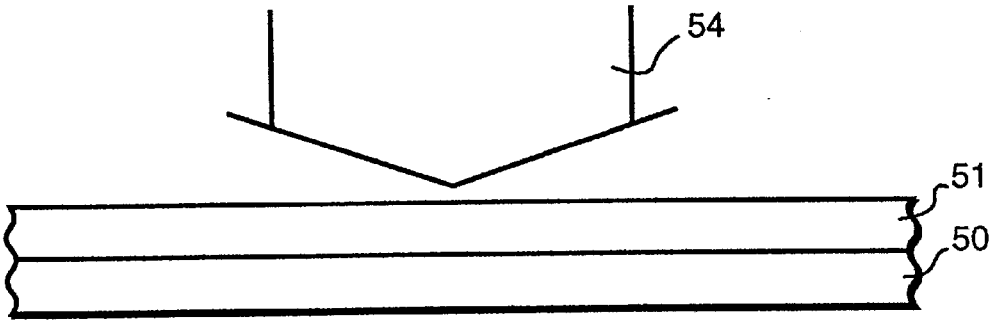
Figure 9C:
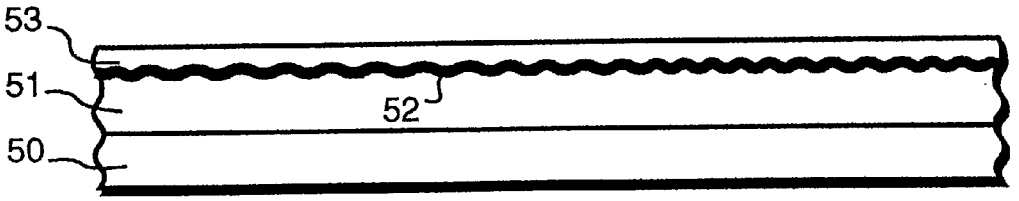
Figure 9D:
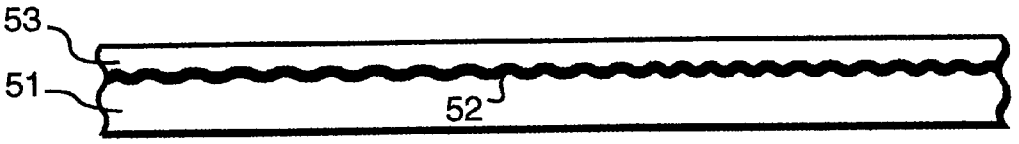

A structure, such as is shown in FIG. 9A, was made of a layer of diamonds 51 having average dimension 20 μm to 1 mm attached using adhesive to a smooth carrier substrate 50. The structure was heated to 350° C. and then, as indicated in FIG. 9B, subjected to a current density of $10^{-5}$ A $cm^{-2}$ of carbon ions 54 with ion energies of 106 keV and ion fluence of $3\times10^{16}$ $cm^{-2}$. The resultant surface was coated with 1 $\mu$m of electron-beam evaporated aluminum 52 followed by an additional aluminum layer 53 more than 100 $\mu$m thick, as shown in FIG. 9C. The adhesive was dissolved to remove the carrier substrate 50 from the diamond and thereby expose the diamond electron-emitting surface, as shown in FIG. 9D. Electrical contact to the emitter was made at the surface of the metal layer 53.

Example 8

Diamond is deposited onto a substrate by CVD. A nickel salt is deposited onto the CVD diamond surface. The structure is annealed in a reducing atmosphere. Additional nickel or copper is deposited onto the nickel metal left behind by the etching operation. The substrate is removed from the CVD layer by exposure to a sulfur hexafluoride plasma or a hydrogen fluoride-nitric acid solution in order to expose the electron-emitting surface. Electrical contact between the emitter and the remainder of the device circuit is made at the metal-plated surface.

It will therefore be seen that the foregoing represents a highly advantageous approach to application of diamonds and other wide-bandgap materials for use in field-emission devices. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. An electron-emissive device comprising:

a. a conductive material;

b. an emitter material joined to the conductive material; and c. an interface therebetween having a roughened morphology to facilitate electron injection into the emitting layer.

2. The device of claim 1 wherein the interface allows electron injection into the emitter material at average field strengths near the interface less than $10^8$ V/cm.

3. The device of claim 1 wherein the interface has a roughness characterized by radius of curvature less than 15 nm.

4. The device of claim 1 wherein the emitter material comprises diamond.

5. The device of claim 4 wherein the diamond is substitutionally doped with nitrogen.

6. The device of claim 5 wherein the diamond has a nitrogen dopant level ranging from $10^{18}$ to $10^{21}$ atoms/$cm^3$.

7. The device of claim 5 wherein the nitrogen is present in a concentration sufficient to facilitate injection of electrons from the conductive material into the diamond at average field strengths near the interface no greater than $10^8$ V/cm.

8. The device of claim 4 wherein the diamond is present in the form of type Ib grit.

9. The device of claim 8 wherein the grit comprises particles having an average mean diameter ranging from 250 to 1000 Å.

10. The device of claim 4 wherein the diamond is in the form of a film.

11. The device of claim 10 wherein the film is formed by chemical vapor deposition.

12. The device of claim 4 wherein the diamond is a single crystal.

13. The device of claim 4 wherein the diamond is formed by chemical vapor deposition.

14. The device of claim 13 wherein the diamond is substitutionally doped with nitrogen.

15. The device of claim 1 wherein the emitter material has a bandgap of at least 2 eV.

16. The device of claim 15 wherein the emitter material comprises silicon carbide.

17. The device of claim 15 wherein the emitter material comprises boron nitride.

18. The device of claim 15 wherein the emitter material comprises aluminum nitride.

19. The device of claim 15 wherein the emitter material comprises gallium nitride.

20. The device of claim 1 wherein the conductive material comprises a metal.

21. The device of claim 1 wherein the conductive material comprises a semiconductor.

22. The device of claim 1 wherein the emitter material has been treated with cesium or a compound thereof.

23. The device of claim 1 wherein the emitter material forms a continuous layer over the conductive material.

24. An electron-emissive device comprising:

a. a conductive material;

b. an emitter material having a roughened surface, joined to the conductive material; and c. an interface therebetween at the roughened surface, the interface having a roughened morphology to facilitate electron injection into the emitting layer.

25. The device of claim 24 wherein the roughened surface has been created by forming a combination of the emitter material with a substance containing a metallic element and heating the combination.

26. The device of claim 25 wherein the combination is the source of the conductive material, heating the combination leaving the conductive material on the emitter material, thereby forming the interface.

27. The device of claim 26 further comprising a conductive substrate, the conductive substrate being in contact with the combination during the heating.

28. The device of claim 27 wherein the conductive material is joined to the conductive substrate.

29. The device of claim 27 wherein the emitter material forms a continuous layer over the conductive substrate.

30. The device of claim 25 wherein the metallic-element-containing substance etches the emitter material.

31. The device of claim 25 wherein the heating is done in a reducing atmosphere.

32. The device of claim 31 wherein the heating is done in a hydrogen-containing atmosphere.

33. The device of claim 25 wherein the heating is done in an atmosphere containing water or water vapor.

34. The device of claim 25 wherein the substance containing a metallic element contains at least one member of the group consisting of iron, nickel, cobalt, titanium, and a lanthanide.

35. The device of claim 34 wherein the substance containing a metallic element contains nickel.

36. The device of claim 35 wherein the nickel-containing substance is a nickel salt.

37. The device of claim 36 wherein the nickel salt is one of nickel sulfate, nickel chloride, nickel acetylacetonate, and nickel acetylacetonate hydrate.

38. The device of claim 34 wherein the substance containing a metallic element contains both nickel and cerium.

39. The device of claim 38 wherein the nickel- and cerium-containing substance is a nickel-cerium alloy.

40. The device of claim 25 wherein the substance containing a metallic element also contains carbon.

41. The device of claim 24 wherein the conductive material is a conductive layer through which electrical contact is made to the device.

42. The device of claim 41 wherein the emitter material forms a continuous layer over the conductive layer.

43. The device of claim 24 wherein the emitter material has been chemically or structurally modified so as to improve emission performance.

44. The device of claim 43 wherein the modification comprises doping the emitter material.

45. The device of claim 43 wherein the modification comprises reduction of the work function of the emitter material.

46. The device of claim 45 wherein the modification is accomplished by exposure of the emitter material to cesium metal or a compound thereof.

47. The device of claim 24 wherein the roughened surface of the emitter material is formed by ion bombardment.

48. The device of claim 47 wherein the ion bombardment is by carbon ions.

49. The device of claim 47 wherein the ion bombardment is by xenon ions.

50. The device of claim 24 wherein the roughened surface of the emitter material is formed by depositing a mask material over at least part of the emitter material and exposing the emitter material to an anisotropically etching atmosphere.

51. The device of claim 50 wherein the emitter material comprises diamond.

52. The device of claim 50 wherein the etching atmosphere comprises a gas.

53. The device of claim 52 wherein the gas includes an oxygen-containing species.

54. The device of claim 52 wherein the oxygen-containing species is nitrogen dioxide.

55. The device of claim 52 wherein the emitter material comprises diamond.

56. The device of claim 50 wherein the etching atmosphere comprises a plasma.

57. The device of claim 50 wherein the etching atmosphere comprises an ion beam.

58. The device of claim 50 wherein the etching atmosphere comprises an ion beam and a gas.

59. The device of claim 50 wherein the mask material comprises aluminum.

60. An electron-emissive device comprising:

a. an emitter material;

b. a semiconductive material, at least one of the emitter material and the semiconductive material having a roughened surface; and c. an interface between the emitter and semiconductive materials at the roughened surface.

61. An electron-emissive device comprising:

a. an emitter material having a bandgap of at least 2 eV;

b. a conductive material, at least one of the emitter material and the conductive material having a roughened surface; and c. an interface between the emitter and conductive materials at the roughened surface.

62. The device of claim 61 wherein the emitter material comprises diamond.

63. The device of claim 62 wherein the diamond is substitutionally doped with nitrogen.

64. The device of claim 63 wherein the diamond is formed by chemical vapor deposition.

65. The device of claim 63 wherein the nitrogen is present in a concentration ranging from $10^{18}$ to $10^{21}$ atoms/cm$^3$.

66. The device of claim 63 wherein the nitrogen is present in a concentration sufficient to facilitate injection of electrons from the conductive material into the diamond at average field strengths near the interface no greater than $10^8$ V/cm.

67. The device of claim 62 wherein the diamond is in the form of type Ib grit.

68. The device of claim 67 wherein the grit comprises particles having an average mean diameter ranging from 250 to 1000 Å.

69. The device of claim 62 wherein the diamond is in the form of a film.

70. The device of claim 69 wherein the film of diamond is formed by chemical vapor deposition.

71. The device of claim 70 wherein the diamond is substitutionally doped with nitrogen.

72. The device of claim 62 wherein the diamond is in the form of a single crystal.

73. The device of claim 62 wherein the diamond is formed by chemical vapor deposition.

74. An electron-emissive device comprising:

a. an emitter material;

b. a conductive material; and c. an interface therebetween having a roughness characterized by a radius of curvature less than 15 nm.

75. An electron-emissive device comprising:

a. an emitter material having a bandgap of at least 2 eV;

b. a conductive material; and c. an interface therebetween having sufficient roughness to allow electron injection from the conductive material into the emitter material at average field strengths near the interface less than $10^8$ V/m.

76. An electron-emissive device comprising:

a. a conductive material;

b. an emitter material comprising diamond Ib grit, the emitter material having a roughened surface created by (i.) forming a combination of the emitter material with a substance containing a metallic element belonging to the group consisting of iron, nickel, cobalt, titanium, and a lanthanide and (ii.) heating the combination in a reducing atmosphere; and c. an interface between the conductive material and the emitter material at the roughened surface.

77. The device of claim 76 wherein the metallic element is nickel.

78. An electron-emissive device comprising:

a. an emitter material having a bandgap of at least 2 eV and having a surface treated by ion bombardment;

b. a conductive material; and c. an interface between the conductive and emitter materials at the surface treated by ion bombardment.

79. The device of claim 78 wherein the emitter material comprises diamond.

80. The device of claim 78 wherein the ions are xenon ions.

81. The device of claim 78 wherein the ions have mean energy less than 20 keV.

82. The device of claim 78 wherein the ions have mean energy less than 5 keV.

83. The device of claim 78 wherein the ions have mean energy less than 1 keV.

84. An electron-emissive device comprising:

a. an emitter material having a roughened surface;

b. a conductive material; and c. an interface therebetween at the roughened surface, the interface having sufficient roughness to allow electron injection from the conductive material into the emitter material at average field strengths near the interface less than $10^8$ V/m.

* * * * *